US005633613A

United States Patent [19]

MacDonald

[11] Patent Number: 5,633,613

[45] Date of Patent: May 27, 1997

[54] MODULATOR-COUPLED TRANSMISSION STRUCTURE AND METHOD

[75] Inventor: Perry A. MacDonald, Culver City, Calif.

[73] Assignee: Hughes Electronics, Los Angeles, Calif.

[21] Appl. No.: 393,593

[22] Filed: Feb. 22, 1995

[51] Int. Cl.[6] ..... H01Q 13/08; H01P 5/00

[52] U.S. Cl. ..... 332/163; 333/116; 333/164; 455/327; 455/330; 343/700 MS

[58] Field of Search ..... 333/116, 164, 333/246; 343/700 MS; 455/81, 325, 327, 330; 332/163, 129, 175, 176

[56] References Cited

U.S. PATENT DOCUMENTS

| | | | |
|---|---|---|---|
| 3,771,075 | 11/1973 | Phelan | 333/246 |
| 4,899,164 | 2/1990 | McGrath | 343/770 X |
| 4,955,079 | 9/1990 | Connerney et al. | 455/325 |
| 5,001,692 | 3/1991 | Shapiro et al. | 343/700 MS |
| 5,303,419 | 4/1994 | Ihipiboon et al. | 455/327 |
| 5,309,163 | 5/1994 | Ngan et al. | 343/700 MS |

FOREIGN PATENT DOCUMENTS

| | | | |
|---|---|---|---|
| 1647705 | 5/1991 | Russian Federation | 333/250 |
| 1755341 | 8/1992 | Russian Federation | 333/164 |

OTHER PUBLICATIONS

*McGraw–Hill Electronics Dictionary*, Fifth Edition, 1994, McGraw–Hill, INc., New York, p. 265.

Pozar, David M., "A Reciprocity Method of Analysis for Printed Slot and Slot–Coupled Microstrip Antennas", *IEEE Transactions on Antennas and Proagation*, vol. AP–34, No. 12, Dec 1986, pp. 1439–1446.

Sullivan, Peter L., et al., "Analysis of an Aperture Coupled Microstrip Antenna", *IEEE Transactions on Antennas and Propagation*, vol. AP–34, No. 8, Aug. 1986, pp. 977–984.

Herscovici, Naftali, I. and Pozar, D. M., "Analysis and Design of Multilayer Printed Antennas", *IEEE Transactions on Antennas and Propagation*, vol. 41, No. 10, Oct. 1993, pp. 1371–1378.

*Primary Examiner*—Robert Pascal
*Assistant Examiner*—Arnold Kinkead
*Attorney, Agent, or Firm*—V. D. Duraiswamy; W. K. Denson-Low

[57] ABSTRACT

The microwave impedance across an aperture in a conductive shield member of a transmission structure is varied as a microwave signal transits the aperture. The impedance is changed by positioning a variable impedance device across the aperture. A slit divides the shield member into two portions to facilitate the application of a modulating signal (56) across the device.

21 Claims, 3 Drawing Sheets

MODULATOR-COUPLED TRANSMISSION STRUCTURE AND METHOD

BACKGROUND OF THE INVENTION

1. Field of the Invention

The present invention relates generally to microwave phase and amplitude modulation structures and methods.

2. Description of the Related Art

Microwave transmission lines are conductive structures that form continuous paths from one point to another for transmission of electromagnetic energy. A transmission line conventionally includes two associated conductive members; a signal directing member that defines the signal path and a signal return member that completes a closed signal path. At low frequencies at which the signal wavelength is substantially longer than the transmission line structure, these members may take the form of two parallel wires and signal transmission can be analyzed in terms of member voltages and currents. At microwave frequencies (typically considered to be about $10^9$–$10^{12}$ Hz) the signal wavelength can be comparable to the size of the transmission line structure, and signal transmission is generally analyzed in terms of distributed circuit theory. At these frequencies, energy will rapidly radiate away from the transmission line unless one of the transmission members is configured to function as a containment or shield member.

Accordingly, microwave transmission lines typically include a signal member and a shield member. For example, a coaxial line has a usually cylindrical wire and a hollow cylindrical shield that is coaxially arranged with the wire. In this transmission structure, the electromagnetic field is completely enclosed between the signal and shield members.

As a second example, a stripline transmission line has a rectangular signal member positioned between a pair of parallel, flat shield members that are typically referred to as "ground planes". In this transmission structure, the electromagnetic fields are no longer completely enclosed but the shield members preferably extend sufficiently in the line's transverse direction to contain the majority of the electromagnetic fringe field.

The dimensions of a transmission line's signal and shield members and the signal line's termination impedance determine the line's impedance at any other point. With a specified termination, the impedance along the transmission line becomes a function of the distance from that termination. For example, if the signal member of a transmission line is terminated in an open circuit (high impedance), the line impedance will be a low impedance at a point $\lambda/4$ from the open circuit and will again be a high impedance at a point $\lambda/2$ from the open circuit (in which $\lambda$ is the signal wavelength).

Microwave signal energy can be effectively coupled through an aperture that is formed in the shield member of a transmission line. For example, Pozar has analyzed two antenna structures that are based on the use of shield member apertures (Pozar, David M., "A Reciprocity Method of Analysis for Printed Slot and Slot-Coupled Microstrip Antennas", *IEEE Transactions on Antennas and Propagation*, Vol. AP-34, No. 12, December, 1986, pp. 1439–1446). In the first structure, an electromagnetic signal is radiated directly from a microstrip signal member through an aperture in the shield member. This antenna structure is called a "microstripline-fed printed slot". The second structure is an "aperture-coupled patch antenna". In this structure, the aperture is positioned between the signal member and a radiating patch member. The patch is generally a square or rectangular conductive sheet that is printed on a dielectric substrate.

Transmission line shield apertures can be used to effectively reduce the size of coupled signals in multilayer, microwave transmission structures. For example, Hersovici and Pozar (Herscovici, Naftali, I. and Pozar, D. M., "Analysis and Design of Multilayer Printed Antennas", *IEEE Transactions on Antennas and Propagation*, Vol. 41, No. 10, October 1993, pp. 1371–1378) provide an illustration (FIG. 1) that shows a multilayer stripline structure in which 1) a first shield aperture couples radiation from an entry stripline to a primary stripline feed network, 2) a set of shield apertures couples energy from the primary feed network to a secondary stripline feed network, and 3) a second set of shield apertures couples energy from the secondary feed network to the patches of a patch antenna.

Although the control of microwave energy flow in compact microwave circuit designs is facilitated by apertures in shield members, phase modulation and amplitude modulation circuits are typically realized with configurations that require relatively greater space. For example, a phase modulator may have two phases which are realized by switching between signal members that have different path lengths. In another configuration, a signal member of a fixed path length is terminated with a variable reactance device.

SUMMARY OF THE INVENTION

The present invention is directed to modulator-coupled, transmission line structures which facilitate size reduction in microwave modulation circuits. This goal is realized by the recognition that a microwave signal may be modulated by varying the microwave impedance of an aperture as the signal is coupled through the aperture.

The inventor uses this recognition to provide modulators that have a microwave variable impedance device positioned across the aperture of a transmission structure shield member. In one embodiment, the device exhibits a variable reactance which modulates the microwave signal phase. In another embodiment, the device exhibits a variable resistance which modulates the microwave signal amplitude.

Modulators in accordance with the invention may be used as modulator couplers between a pair of signal members as in a transmission line structure, or between a signal member and space as in an antenna structure.

The novel features of the invention are set forth with particularity in the appended claims. The invention will be best understood from the following description when read in conjunction with the accompanying drawings.

DETAILED DESCRIPTION OF THE INVENTION

Figure 1:
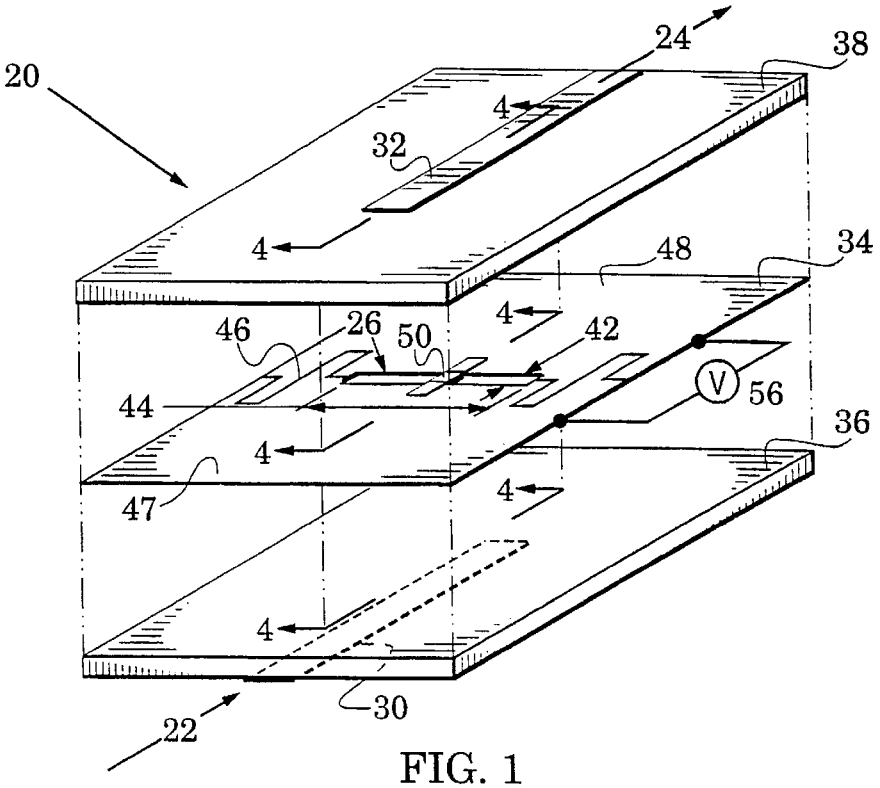
FIG. 1 is an exploded, perspective view of a modulator-coupled transmission line in accordance with the present invention.

FIGS. 1–4 illustrate a modulator-coupled transmission structure in accordance with the present invention. This structure is a modulator-coupled transmission line 20 that modulates an input signal 22 on one signal path into a modulated output signal 24 on another signal path. The modulation can be either phase or amplitude modulation, depending upon the type of variable impedance device that is positioned across an aperture 26 of the transmission structure.

The transmission line 20 includes input and output signal members in the form of a microstrip signal lines 30 and 32 that share a microstrip shield member in the form of a ground plane 34. The signal lines 30 and 32 are respectively carried on dielectric substrates 36 and 38 which space the lines from the ground plane 34 in accordance with conventional microstrip fabrication techniques.

The aperture 26 is formed in the microwave ground plane 34 with a width 42 and a length 44. The width 42 can be selected to adjust the coupling coefficient between the signal lines. The length 44 is preferably selected to be large enough to include substantially all of the transverse fringe electromagnetic field of each signal line, i.e., sufficiently large enough to prevent a significant portion of signals on the signal lines 32 and 34 from bypassing the aperture 26.

Figure 3:
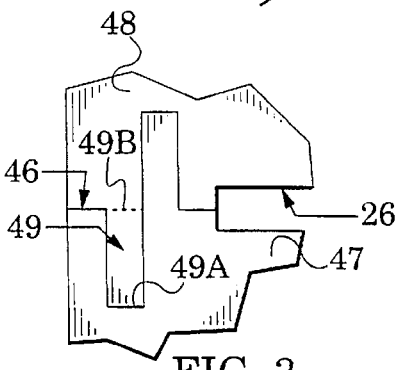
FIG. 3 is an enlarged view of a shield member slit in the modulator of FIG. 1.
Figure 2:
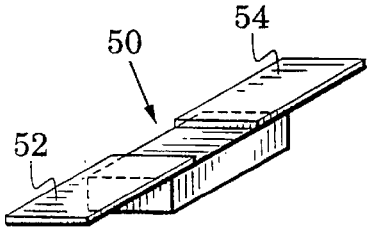
FIG. 2 is an enlarged perspective view of a variable impedance device used in the modulator of FIG. 1.
Figure 4:
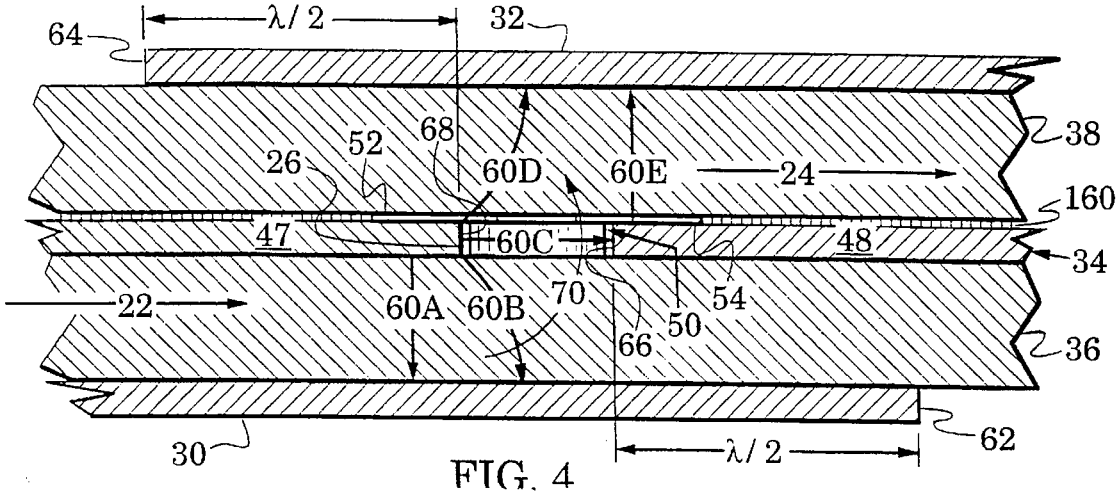
FIG. 4 is an enlarged sectional view along the plane 4—4 of FIG. 1.

A pair of slits 46 are formed in the ground plane 34 and they extend from each end of the aperture 26 to separate the ground plane into first and second portions 47, 48. The slits 46 block low-level, direct-current signals, e.g., <50 volts, between the portions 47 and 48. They are preferably arranged in a pattern that facilitates the flow of microwave ground currents between the portions 47 and 48. FIGS. 1 and 3 illustrate an exemplary serpentine pattern which defines interdigitated shield member legs, e.g., the leg 49 that extends from a leg end 49A to another leg end indicated by the broken line 49B. The interdigitated legs 49 encourage inductive microwave coupling between the portions 47 and 48.

A variable impedance device 50 is positioned across the aperture 26 with its electrodes 52 and 54 electrically connected to the ground plane portions 47 and 48, respectively. A modulation signal 56 is imposed across the ground plane portions 47, 48 and, hence, also across the variable-impedance device 50. The frequency of the modulation signal is well below microwave frequencies so that this signal is effectively blocked by the slit 46.

An operational description of the modulator-coupled transmission line 20 will now be given with reference to the electric fields of the input and output signals 22 and 24. Accordingly, an electric field vector 60A of the input signal 22 is shown to be directed between the ground plane 34 and the signal line 30, as it would be in a typical TE10 electromagnetic mode. FIG. 3 illustrates that the signal lines 30 and 32 extend past the aperture 26 by a distance of $\lambda/2$. Because these lines terminate at their respective ends 62 and 64 in open circuits, they present a high impedance at the plane of their respective edges 66 and 68 of the aperture 26.

Thus, as the vector 60A reaches the aperture 26, it is urged to "wrap around" the ground plane 34 as shown by its successive positions 60B, 60C, 60D and 60E (and as also indicated by the curved transistion arrow 70). The high impedance of the signal line 32 at the aperture edge 68 urges the output signal 24 to flow away from the aperture as the signal 24.

Figure 5A:
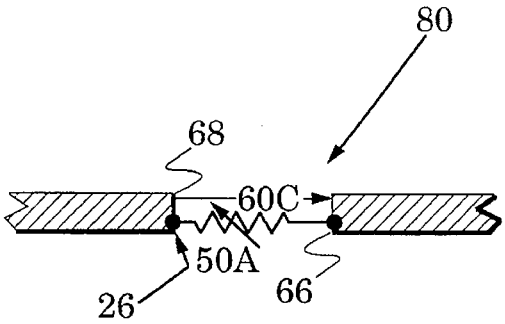
FIG. 5A is a schematic view, along the plane 4—4, of an aperture and one embodiment of the variable impedance device of FIG. 1.

As shown in more detail in FIG. 5A, the electric field vector 60C is arranged across the aperture 26 and, therefore, across the variable impedance device. If this device is a variable resistance device 50A, an amplitude modulator 80 is formed. The resistance of the device 50A varies with the modulation signal (56 in FIG. 1) and this changing resistance causes the amplitude of the electric field vector 60C to vary accordingly. An exemplary variable resistance device for use in the modulator 80 is a p-i-n diode. These diodes are typically configured with a high-resistivity intrinsic region. The stored charge and, therefore, the resistivity of the intrinsic region is a function of a modulating signal that is applied to the device.

Figure 5B:
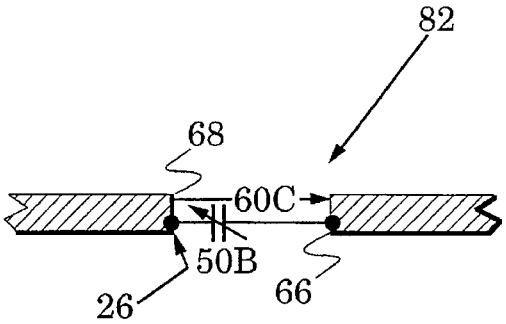
FIG. 5B is a fragmentary sectional view, along the plane 4—4, of an aperture and another embodiment of the variable impedance device of FIG. 1.

If the device across the aperture is a variable reactance device 50B as illustrated in FIG. 5B, a phase modulator 82 is formed. The reactance of the device 50B varies with the modulation signal, and this changing reactance causes the phase of the electric field vector 60C to vary accordingly. An exemplary variable reactance device for use in the modulator 82 is a varactor. Varactor diodes are typically configured to emphasize the capacitance of their semiconductor junction, and this junction capacitance varies with a modulating signal that is applied to the device.

Figure 6A:
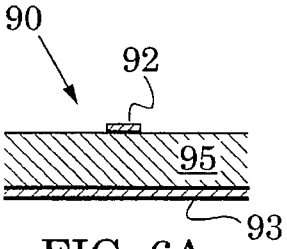
FIGS. 6A–6G are sectional views of exemplary microwave transmission structures that can be used in other embodiments of the modulator-coupled transmission line of FIG. 1.
Figure 6B:
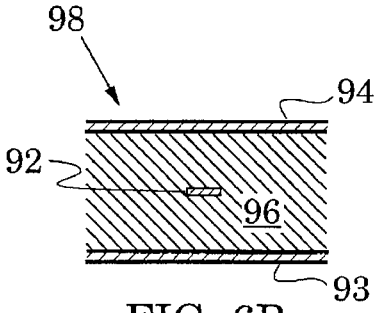
Figure 6C:
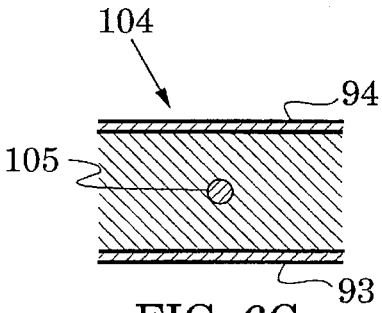

Although the embodiment 20 is configured with a microstrip transmission structure, the teachings of the invention may be practiced with any transmission structure that has a shield member, such as those illustrated in FIGS. 6A–6G. FIG. 6A shows a typical microstrip transmission line 90 that has a rectangular signal member 92 positioned above a shield member 93. The signal member 92 and the shield member 93 are often realized as a printed conductive line and a sheet on opposite sides of an electrical dielectric 95. FIG. 6B illustrates a balanced stripline transmission line 98. The line 98 is similar to the line 90 but has the signal member 92 positioned between a pair of shield members 93, 94. A dielectric 96 typically holds the signal member 92 in place. A slab transmission line 104 is shown in FIG. 6C. This line is similar to the stripline 98, but it replaces the rectangular signal member 92 with a cylindrical signal member 105.

Figure 6D:
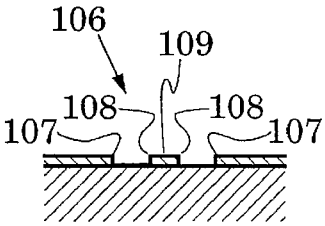
Figure 6E:
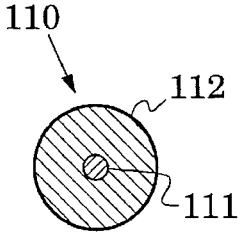
Figure 6F:
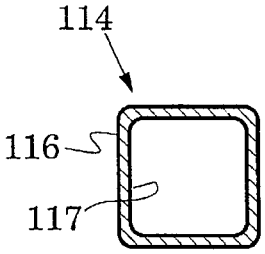
Figure 6G:
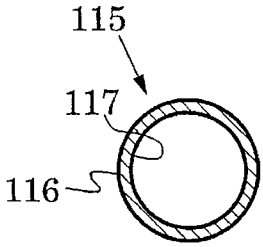

A coplanar waveguide 106 is shown in FIG. 6D. It has two parallel signal members that are formed by the edges 107, 108 in a conductive sheet. The center portion 109 of the conductive sheet is the shield member between the signal members. In the conventional coaxial transmission line 110 of FIG. 6E, a coaxial signal member 111 is surrounded by a coaxially arranged cylindrical shield member 112. FIGS. 6F and 6G illustrate rectangular and circular waveguides 114, 115. The shield members are the waveguide walls 116. The signal member has now become the inner surface 117 of the walls where the electromagnetic signal travels by the skin effect phenomenon.

Figure 7:
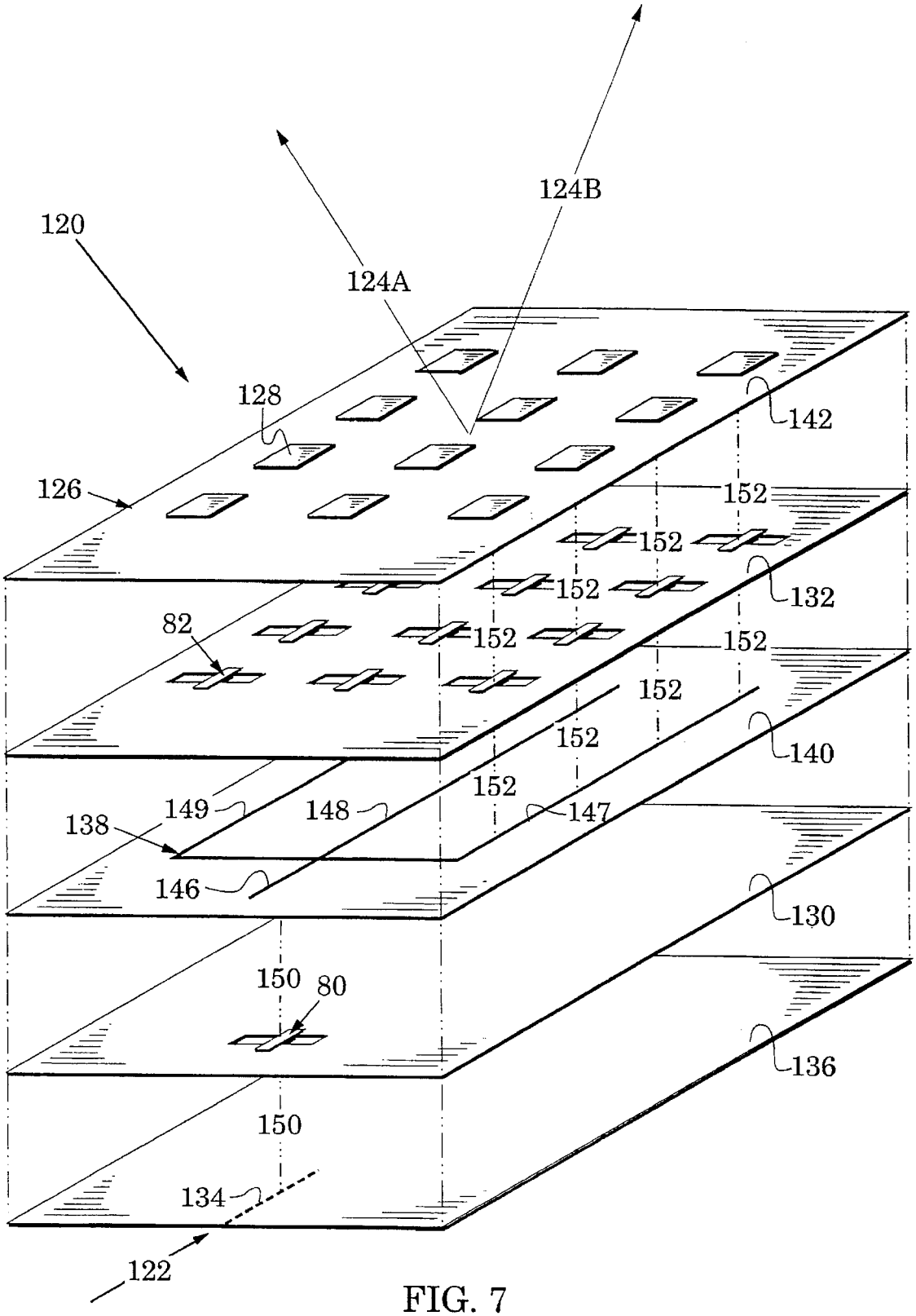
FIG. 7 is a schematized, exploded, perspective view of a modulator-coupled antenna in accordance with the present invention.

The teachings of the invention are especially suited for reducing the size of microwave transmission structures through the use of multilayer techniques. For example, FIG. 7 schematically illustrates another modulator-coupled transmission structure in accordance with the present invention. This structure is a modulator-coupled antenna 120 that modulates an input signal 122 into a modulated output signal which is radiated from a phased-array radiator 126 as an antenna beam. The beam axis can be selectively steered as indicated by different beam axes 124A and 124B.

In particular, the radiator 126 includes a plurality of radiator members in the form of patches 128. Each patch is a conductive sheet that is carried on an underlying substrate and is configured to receive microwave energy, e.g., from an aperture, and reradiate this energy to form an antenna beam. With proper phasing of the signal that is radiated from each of the patches 128, the spatial direction of the radiated signal (the signal formed from the combination of the patch signals) can be electronically steered.

The antenna 120 has shield members in the form of ground planes 130 and 132. It also has signal members in the form of an input transmission line 134 that is carried on the lower surface of a dielectric substrate 136, a distribution transmission line 138 that is carried on a dielectric substrate 140 and the radiator members (i.e., patches) 128 that are carried on a dielectric substrate 142. The distribution transmission line 138 includes a supply line 146 which branches into three feed lines 147, 148 and 149.

The input line 134 and the ground plane 130 form a microstrip transmission structure. The patches 128 and the ground plane 132 form another microstrip transmission structure. The distribution line 138 and the ground planes 130, 132 form a balanced stripline transmission structure.

An amplitude modulator 80 (as illustrated in FIG. 5A) is positioned in the ground plane 130 to couple and amplitude modulate the input signal 122 onto the supply line 146, as schematically indicated by the broken lines 150. A plurality of phase modulators 82 (as illustrated in FIG. 5B) are positioned in the ground plane 132 to couple and phase modulate signals from the feed lines 147, 148 and 149 onto the patches 128. This is schematically indicated, in the case of the feed line 147, by the broken lines 152. The aperture dimension which is parallel with each feed line (similar to the dimension 42 in FIG. 1) can be selected to adjust the energy amplitude that is coupled from each of the feed lines 147, 148 and 149 to their respective patches.

In operation, the phase of the energy that is coupled to each patch 128 is selectively set by a modulation signal which is placed on its respective modulator 82. This control of the radiation phase from the patches enables a control over the electronic direction of an antenna beam that radiates from the radiator 126; two possible beam axes 124A and 124B are illustrated. The antenna beam can be selectively turned on and off by a signal which is placed on the modulator 80. Alternatively, the antenna beam can be amplitude modulated in accordance with a modulation signal applied to the modulator 80. To facilitate the application of modulating signals to the amplitude and phase modulators 80 and 82, the shield members 130 and 132 preferably define slits as shown in FIG. 1 (see slits 46). For clarity of illustration, these slits are not shown in FIG. 7.

Another modulator-coupled antenna structure can be realized by removing the radiator 126 from FIG. 7. The energy to form the antenna beam is now directly radiated from the phase modulators 82 in the shield member 132.

Exemplary variable resistance devices that can be used to realize the amplitude modulator are the MA4GP900 series, GaAs beam lead p-i-n diodes manufactured by M/A-COM, Inc. of Burlington, Mass. Their resistance is a function of their current and can be varied over more than a decade, e.g., from 3 to 40 ohms at a 10 GHz signal frequency. These devices have a width and length of approximately 0.2×0.8 millimeter. In the elevation dimension, their electrodes are thin enough to fit into the same space that is typically used for an adhesive bond line 160 which is shown in FIG. 1 between the shield member 34 and the substrate 38.

Exemplary variable reactance devices that can be used to realize the phase modulator are the MA46600 series, GaAs abrupt junction tuning varactors which are also manufactured by M/A-COM, Inc. Their capacitance is a function of the applied voltage. They are intended for operation from the L to Ka band of frequencies and can be modulated at high frequencies such as 50 MHz. The physical size of these devices is similar to that of the beam lead p-i-n diodes that are described above.

The invention facilitates the realization of signal modulation in compact microwave transmission structures. While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

I claim:

1. A modulator for modulating a microwave signal with a modulation signal, comprising:

an input signal member for receiving a microwave signal;

an output signal member;

a shield member positioned between said input and output signal members with each of said input and output signal members spaced from said shield member;

an aperture formed by said shield member and positioned to couple at least a portion of said microwave signal from said input signal member to said output signal member; and a microwave variable impedance device which is responsive to a modulation signal and is positioned across said aperture to modulate said portion of said microwave signal as it passes through said aperture.

2. A modulator for modulating a microwave signal with a modulation signal, comprising:

an input signal member for receiving a microwave signal;

an output signal member;

a shield member positioned between said input and output signal members;

an aperture formed by said shield member and positioned to couple at least a portion of said microwave signal from said input signal member to said output signal member;

a microwave variable impedance device which is responsive to a modulation signal and is positioned across said aperture to modulate said portion of said microwave signal as it passes through said aperture; and at least one slit formed by said shield member, said slit extending from said aperture and dividing said shield member into first and second shield member portions with said microwave variable impedance device connected between said first and second shield member portions.

3. The modulator of claim 1, wherein said microwave variable impedance device is a variable reactance device.

4. The modulator of claim 3, wherein said variable reactance device is a varactor.

5. The modulator of claim 1, wherein said microwave variable impedance device is a variable resistance device.

6. The modulator of claim 5, wherein said variable resistance device is a p-i-n diode.

7. The modulator of claim 1, wherein said input signal member and said shield member form an input microstrip transmission line, and said output signal member and said shield member form an output microstrip transmission line.

8. The modulator of claim 1, wherein said input signal member and said shield member form an input microstrip transmission line, and said output signal member and said shield member form an output patch radiator.

9. A microwave radiator, comprising:

a signal member for receiving a microwave signal;

a shield member spaced from said signal member having first and second shield member portions;

an aperture formed by said shield member and positioned to couple through said aperture at least a portion of said microwave signal from said signal member; and a microwave variable impedance device which is responsive to a modulation signal and is positioned across said aperture to modulate said portion of said microwave signal as it passes through said aperture.

10. The radiator of claim 9, wherein said microwave variable impedance device is a variable reactance device.

11. The radiator of claim 9, wherein said microwave variable impedance device is a variable resistance device.

12. The radiator of claim 9, wherein said signal member and said shield member form a microstrip transmission line.

13. A microwave radiator, comprising:

a signal member for receiving a microwave signal;

a shield member spaced from said signal member;

an aperture formed by said shield member and positioned to couple through said aperture at least a portion of said microwave signal from said signal member;

a microwave variable impedance device which is responsive to a modulation signal and is positioned across said aperture to modulate said portion of said microwave signal as it passes through said aperture; and at least one slit formed by said shield member, said slit extending from said aperture and dividing said shield member into first and second shield member portions with said microwave variable impedance device connected between said first and second shield member portions.

14. A modulator for modulating and radiating a microwave signal with a modulation signal, comprising:

an input microstrip signal line for receiving a microwave signal;

an output microstrip signal line;

a microstrip shield member positioned between said input and output microstrip signal lines with each of said input and output microstrip signal lines spaced from said shield member;

an aperture formed by said microstrip shield member and positioned to couple at least a portion of said microwave signal from said input microstrip signal line to said output microstrip signal line; and a microwave variable impedance device which is responsive to said modulation signal and is positioned across said aperture to modulate said portion of said microwave signal as it passes through said aperture.

15. The modulator of claim 14, wherein said microwave variable impedance device is a variable reactance device.

16. The modulator of claim 14, wherein said microwave variable impedance device is a variable resistance device.

17. A microwave radiator, comprising:

a microstrip signal line for receiving a microwave signal;

a radiator patch;

a microstrip shield member positioned between said microstrip signal line and said radiator patch with each of said microstrip signal line and said radiator patch spaced from said shield member;

an aperture formed by said microstrip shield member and positioned to couple at least a portion of said microwave signal from said microstrip signal line to said radiator patch; and a microwave variable impedance device which is responsive to a modulation signal and is positioned across said aperture to modulate said portion of said microwave signal as it passes through said aperture.

18. The radiator of claim 17, wherein said microwave variable impedance device is a variable reactance device.

19. The radiator of claim 17, wherein said microwave variable impedance device is a variable resistance device.

20. The modulator of claim 14, further including at least one slit formed by said shield member, said slit extending from said aperture and dividing said shield member into first and second shield member portions with said microwave variable impedance device connected between said first and second shield member portions.

21. The radiator of claim 17, further including at least one slit formed by said shield member, said slit extending from said aperture and dividing said shield member into first and second shield member portions with said microwave variable impedance device connected between said first and second shield member portions.

* * * * *